US011577508B2

(12) United States Patent
Nagamochi et al.

(10) Patent No.: US 11,577,508 B2
(45) Date of Patent: Feb. 14, 2023

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventors: Soichiro Nagamochi, Kawasaki (JP); Mineo Shimotsusa, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 232 days.

(21) Appl. No.: 16/919,960

(22) Filed: Jul. 2, 2020

(65) Prior Publication Data

US 2021/0008878 A1 Jan. 14, 2021

(30) Foreign Application Priority Data

Jul. 9, 2019 (JP) ..... JP2019-127883
Jun. 9, 2020 (JP) ..... JP2020-100273

(51) Int. Cl.
*B41J 2/045* (2006.01)
*B41J 2/165* (2006.01)
*B41J 2/14* (2006.01)

(52) U.S. Cl.
CPC ..... *B41J 2/04563* (2013.01); *B41J 2/0458* (2013.01); *B41J 2/14153* (2013.01); *B41J 2/16535* (2013.01)

(58) Field of Classification Search
CPC ..... B41J 2/16579; B41J 2/14088; B41J 2202/13; B41J 2/04563; B41J 2/0458; B41J 2/04541; B41J 2/0451; B41J 2/14072; B41J 2/14153; B41J 2/14129; B41J 2/04548; B41J 2002/14491; B41J 2/0455; B41J 2/2142; B41J 2/16535
See application file for complete search history.

(56) References Cited

U.S. PATENT DOCUMENTS 9,597,871 B2 3/2017 Ike
2015/0321470 A1 11/2015 Ike
2016/0009078 A1* 1/2016 Nagatsuka ..... B41J 2/14153 347/17

FOREIGN PATENT DOCUMENTS

JP 2015-214079 A 12/2015

* cited by examiner

*Primary Examiner* — Jannelle M Lebron
(74) *Attorney, Agent, or Firm* — Venable LLP

(57) ABSTRACT

A highly reliable multilayer structure element substrate according to an embodiment of this present invention comprises: an electrothermal transducer; a temperature detection element formed at a position where the temperature detection element at least partially overlaps the electrothermal transducer in a planar view of the element substrate; and a plurality of wirings connected to the temperature detection element, wherein the temperature detection element can detect temperatures in a plurality of regions when a plurality of different wirings out of the plurality of wirings are selected.

8 Claims, 13 Drawing Sheets

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and particularly to, for example, a printing apparatus that uses, as a printhead, a liquid discharge head incorporating an element substrate to perform printing in accordance with an inkjet method.

Description of the Related Art

Among inkjet printing methods of discharging ink droplets from nozzles and sticking them onto a print medium such as paper or a plastic film, there exist methods using a printhead including a heater configured to generate thermal energy to discharge ink. In a printhead according to this method, an electrothermal transducer configured to generate heat in accordance with energization and a circuit for driving the electrothermal transducer can be formed using a process similar to a semiconductor manufacturing process. Hence, high density integration of nozzles is easy, and highly accurate printing can be achieved.

In such a printhead, an ink discharge failure may occur in all or some of the nozzles of the printhead because of clogging in the nozzles caused by a foreign substance or ink with increased viscosity, bubbles that have entered an ink supply path or nozzles, a change in the wettability on a nozzle surface, or the like. To avoid deterioration of image quality that occurs when such a discharge failure has occurred, an arrangement capable of quickly executing an operation of recovering an ink discharge state or a complementary operation by another nozzle is provided. To quickly execute these operations, it is very important to correctly judge the ink discharge state or the occurrence of a discharge failure at an appropriate time.

Hence, there have conventionally been proposed various ink discharge state judgment methods and apparatuses using these methods.

Japanese Patent Laid-Open No. 2015-214079 discloses a method of detecting temperature lowering, which occurs at the time of normal discharge, to detect a discharge failure. At the time of normal discharge, some of discharged ink droplets come into contact with the anti-cavitation layer of each electrothermal transducer of the printhead, and the temperature detected by a temperature detection element lowers. On the other hand, at the time of ink discharge failure, ink droplets do not come into contact with the anti-cavitation layer, and the temperature of the temperature detection element lowers slowly. Hence, the discharge state can be detected based on the difference in the temperature change.

Furthermore, Japanese Patent Laid-Open No. 2015-214079 discloses an arrangement including an electrothermal transducer configured to supply heat to a liquid such as ink, and two temperature detection elements configured to detect the temperature of the electrothermal transducer and arranged under the electrothermal transducer, thereby comparing output voltages obtained from the temperature detection elements. With this arrangement, it is possible to more correctly judge the discharge state of a liquid such as ink.

To raise the output voltage, that is, to raise the sensitivity because of the nature of detecting the temperature of the electrothermal transducer as a voltage, the element substrate of the printhead described in Japanese Patent Laid-Open No. 2015-214079 employs an arrangement in which the first and second temperature detection elements are arranged in places close to the center of the electrothermal transducer.

However, because of the nature of arranging a plurality of temperature detection elements, a gap where no temperature detection element can be arranged always exists between the first and second temperature detection elements. For this reason, a region where temperature detection cannot be performed always occurs.

SUMMARY OF THE INVENTION

Accordingly, the present invention is conceived as a response to the above-described disadvantages of the conventional art.

For example, an element substrate, a liquid discharge head, and a printing apparatus according to this invention are capable of ensuring a region where temperature detection can be performed and operating at higher reliability.

According to one aspect of the present invention, there is provided an element substrate comprising: an electrothermal transducer; a temperature detection element formed at a position where the temperature detection element at least partially overlaps the electrothermal transducer in a planar view of the element substrate; and a plurality of wirings connected to the temperature detection element, wherein the temperature detection element can detect temperatures in a plurality of regions when a plurality of different wirings out of the plurality of wirings are selected.

According to another aspect of the present invention, there is provided a liquid discharge head using an element substrate having the above-described arrangement, comprising a plurality of nozzles configured to discharge a liquid in correspondence with the plurality of electrothermal transducers.

According to still another aspect of the present invention, there is provided a printing apparatus, using a liquid discharge head having the above-described arrangement as a printhead, for performing printing on a print medium using ink as the liquid, comprising a generation unit configured to generate the control signal that on/off-controls the plurality of switches, a monitor unit configured to monitor a time-rate change of the potential difference output from the comparator, and a judgment unit configured to judge, based on the time-rate change of the potential difference monitored by the monitor unit, whether an ink discharge failure has occurred.

According to still another aspect of the present invention, there is provided a printing apparatus for performing printing on a print medium using a liquid discharge head having the above-described arrangement as a printhead configured to discharge ink as the liquid, comprising a recovery unit configured to recover a discharge state of the ink from the nozzles, and a control unit configured to control the recovery unit in accordance with a result of temperature detection in the plurality of regions.

The invention is particularly advantageous since temperatures in a plurality of regions can be detected by one temperature detection element, and a more reliable element substrate can be provided.

Further features of the present invention will become apparent from the following description of exemplary embodiments (with reference to the attached drawings).

DESCRIPTION OF THE EMBODIMENTS

Figure 1:
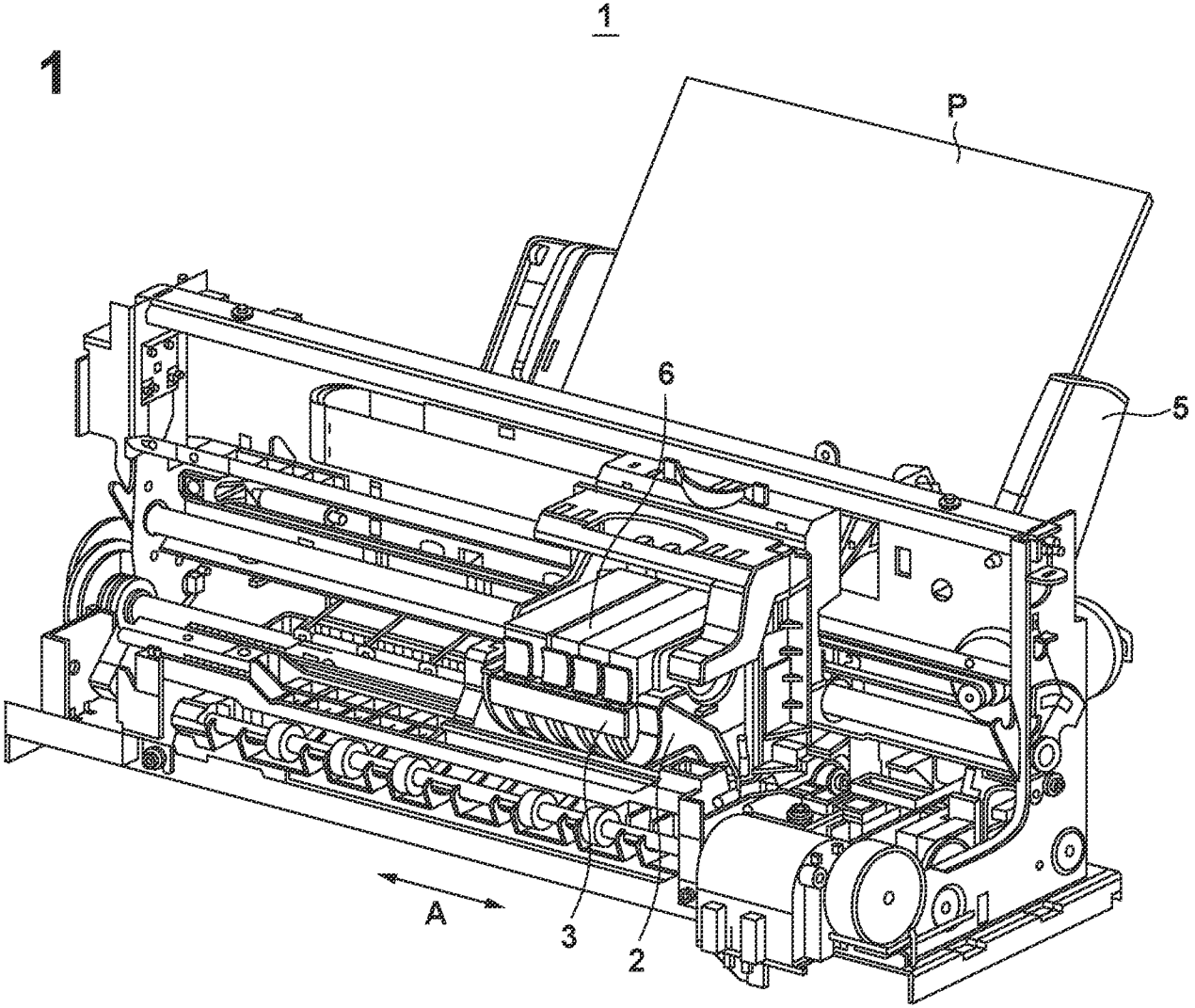
FIG. 1 is a perspective view showing the schematic arrangement of a printing apparatus including a printhead according to an exemplary embodiment of the present invention.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" (to be also referred to as "print element" hereinafter) generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Outline of Printing Apparatus (FIGS. 1 and 2)>

FIG. 1 is an external perspective view showing the outline of the arrangement of a printing apparatus that performs printing using an inkjet printhead (to be referred to as a printhead hereinafter) according to an exemplary embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for the purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducer (heater). The electrothermal transducer is provided in correspondence with each orifice. A pulse voltage is applied to a corresponding electrothermal transducer in accordance with a print signal, thereby discharging ink from a corresponding orifice. Note that the printing apparatus is not limited to the above-described serial type printing apparatus, and the embodiment can also be applied to a so-called full line type printing apparatus in which a printhead (line head)

with orifices arrayed in the widthwise direction of a print medium is arranged in the conveyance direction of the print medium.

Figure 2:
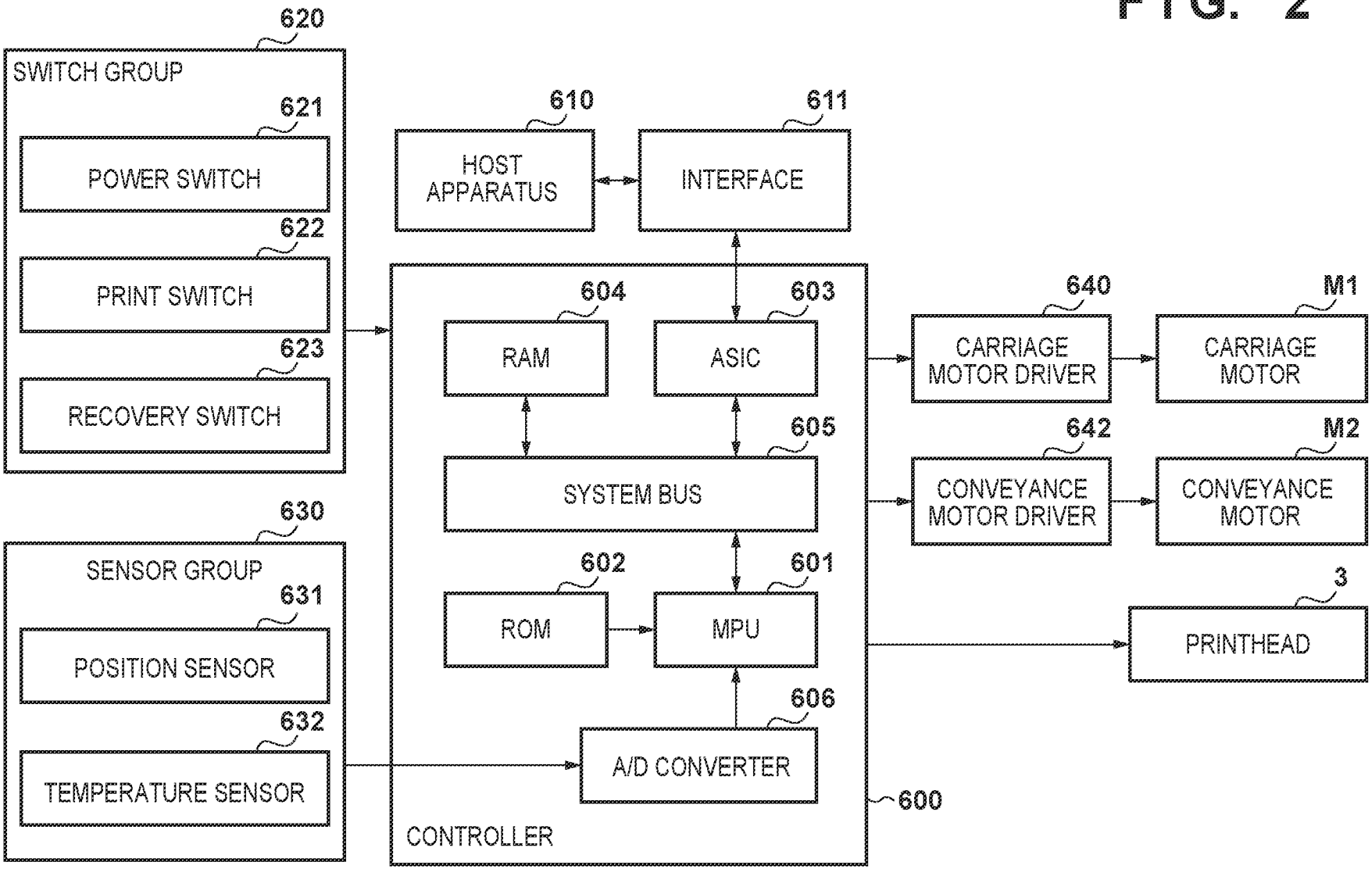
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed by an MPU 601, a ROM 602, an application specific integrated circuit (ASIC) 603, a RAM 604, a system bus 605, an A/D converter 606, and the like. Here, the ROM 602 stores programs corresponding to control sequences to be described later, necessary tables, and other fixed data. The ASIC 603 generates control signals for control of a carriage motor M1, control of a conveyance motor M2, and control of the printhead 3. The RAM 604 is used as an image data expansion area, a working area for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus corresponding to a host shown in FIG. 1 or an MFP, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host.

Reference numeral 620 denotes a switch group which is formed by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive an electrothermal transducer (a heater for ink discharge) to the printhead while directly accessing the storage area of the RAM 604 at the time of print scan by the printhead 3. In addition, the printing apparatus includes a display unit formed by an LCD or an LED as a user interface.

<Description of Outline of Printhead (FIGS. 3A to 5)>

Figure 3B:
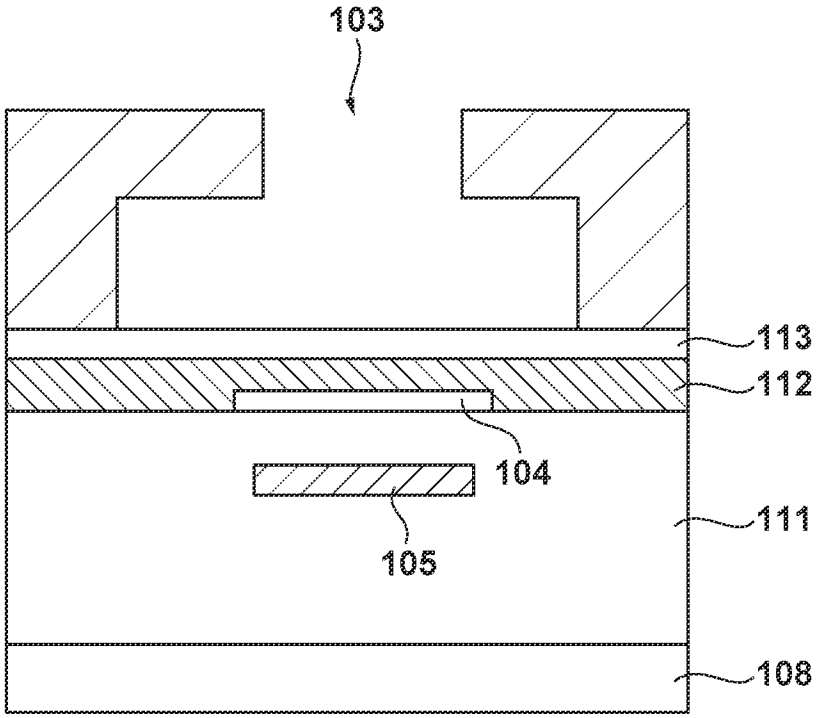
FIGS. 3A and 3B are views schematically showing a part of the element substrate of the printhead including a temperature detection element.
Figure 3A:
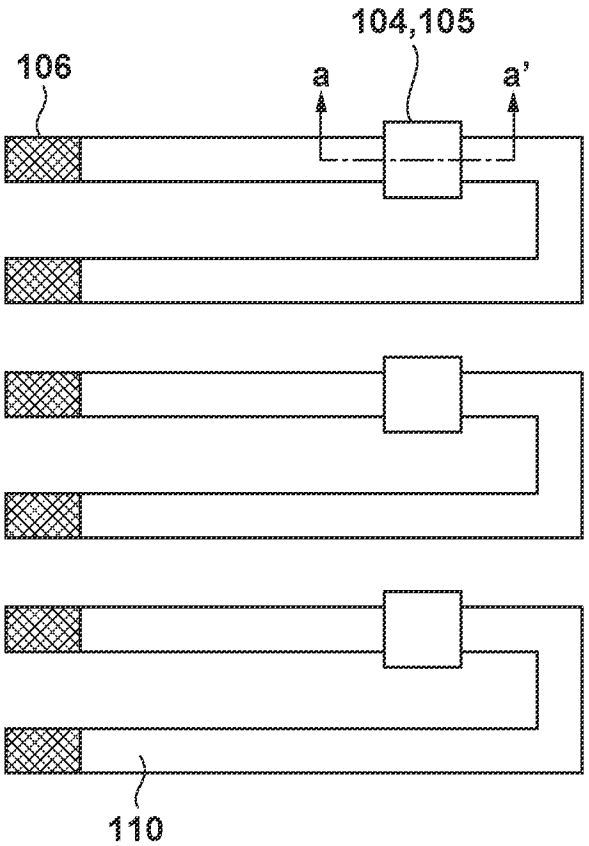

FIGS. 3A and 3B are views schematically showing a part of the element substrate (a heater board or a head substrate) of the printhead 3 including a temperature detection element. FIG. 3A is a plan view of the element substrate viewed from the upper side, and FIG. 3B is a sectional view schematically showing the structure of one heater (electrothermal transducer) 104 and one temperature detection element (temperature sensor) 105 taken along a line a-a' in FIG. 3A.

As shown in FIG. 3A, a terminal 106 connected to the outside and configured to supply power is connected to the heater 104 by wire bonding or the like. In addition, the temperature sensor (temperature detection element) 105 is provided in correspondence with the heater 104. The heater 104 and the temperature sensor 105 are connected to the terminal 106 by an Al (aluminum) wiring 110.

As shown in FIG. 3B, the temperature sensor 105 formed by a thin film resistor whose resistance value changes in accordance with the temperature is arranged on a heat storage layer made of a thermal oxide film $SiO_2$ on an Si substrate 108 that forms the heater board. The temperature sensor 105 is made of Al, Pt, Ti, TiN, Ta, Ir, Cr, W, AlCu, TaSiN, or the like. Furthermore, the Al wiring 110 including an individual wiring for the heater 104, and a wiring that connects the heater 104 and a control circuit configured to selectively supply power to it is formed on the Si substrate 108. Also, the heater 104, a passivation film 112 of SiN or the like, and an anti-cavitation film 113 are densely stacked and arranged via an interlayer insulation layer 111 by a process similar to a semiconductor manufacturing process.

Note that for the anti-cavitation film 113, Ta, Ir, or the like can be used to improve the anti-cavitation properties on the heater 104. In addition, a nozzle 103 configured to discharge ink from a liquid chamber 114 is formed above the heater 104.

As is apparent from the above-described structure, a multilayer structure is formed on the Si substrate 108. The temperature sensor 105 is formed in a layer different from a layer where the heater 104 is formed, and the interlayer insulation layer 111 is formed between them.

An example in which the temperature sensor 105 is arranged under the heater 104 has been described with reference to FIG. 3B. However, the temperature sensor 105 may be arranged between the liquid chamber 114 and the heater 104. In addition, the anti-cavitation film 113 may be used as the temperature sensor.

To detect the temperature of each heater, it is necessary to supply power to the temperature sensor 105 via the terminal 106 and detect and output the voltage of the temperature sensor 105. The carriage 2 includes a terminal configured to supply such power, and a terminal configured to receive the output voltage from the temperature sensor 105. Also, the power supplied via the terminals is output to the main body part of the printing apparatus 1 via a flexible cable (not shown).

In the main body part of the printing apparatus 1, it can be judged, based on temperature information obtained via the flexible cable, whether ink has normally been discharged from each nozzle, or a discharge failure has occurred.

<Relationship between Discharge State and Interlayer Insulation Layer Temperature>

As shown in FIGS. 3A and 3B, the printhead 3 includes the heater (electrothermal transducer) 104 configured to generate thermal energy to basically discharge ink, and the temperature sensor 105 configured to detect a temperature change upon driving.

Figure 4A:
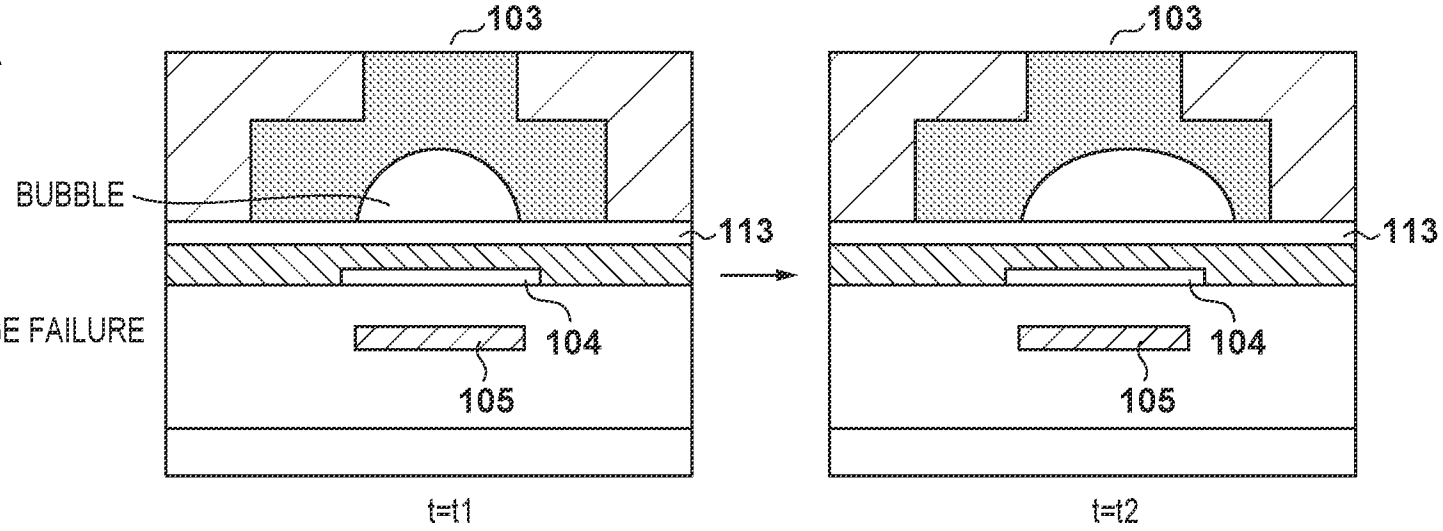
FIGS. 4A and 4B are views showing the state of ink in a nozzle in a case in which ink discharge is normally performed and in a case in which a discharge failure has occurred.
Figure 4B:
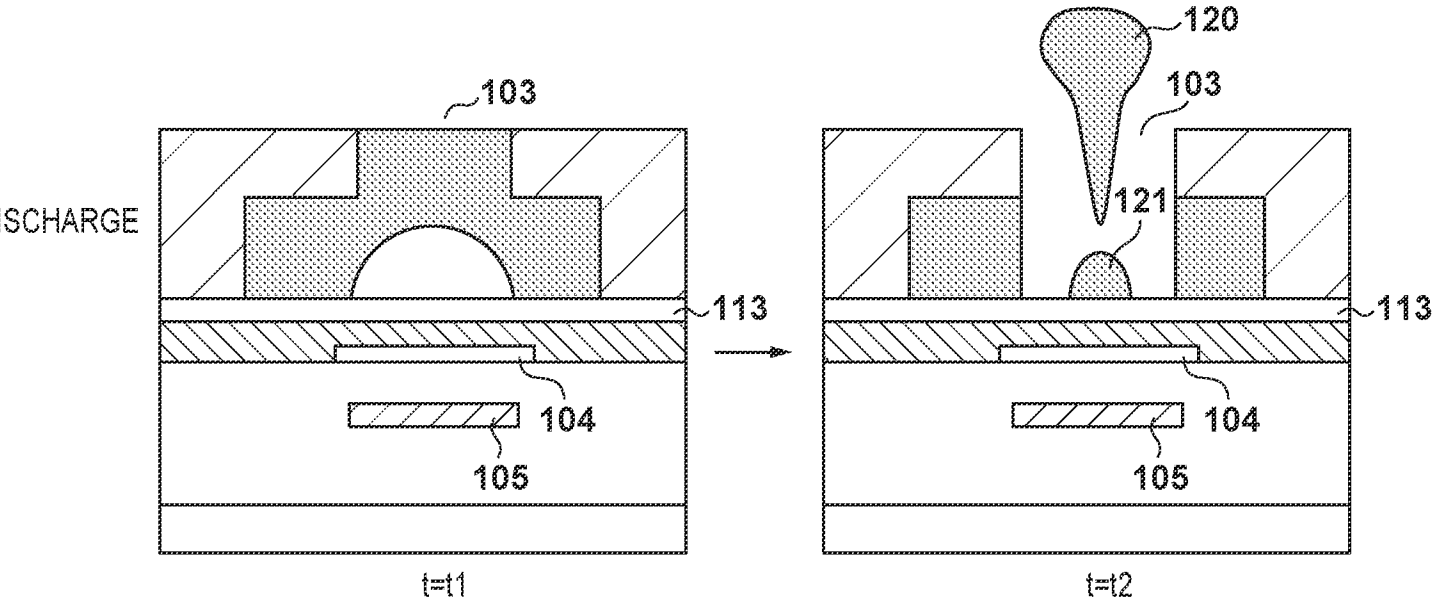

FIGS. 4A and 4B are views showing the states of ink in a nozzle in a case in which ink discharge is normally performed and in a case in which a discharge failure has occurred. In particular, the state on the anti-cavitation film 113 corresponding to the discharge state is shown. FIG. 4A shows the state at the time of a discharge failure, and FIG. 4B shows the state at the time of normal discharge.

As shown in FIGS. 4A and 4B, at elapsed time t=t1 after heating of the heater 104, the anti-cavitation film 113 is covered with bubbles generated by heating at both the time of ink discharge failure and the time of normal discharge. At t=t2 after a predetermined time has elapsed, the bubbles remain on the anti-cavitation film 113 at the time of ink discharge failure. On the other hand, at the time of normal discharge, a part 121 of an ink droplet 120 generated upon discharge is in contact with the surface of the anti-cavitation film 113 that is located immediately above the center portion of the heater 104.

Figure 5:
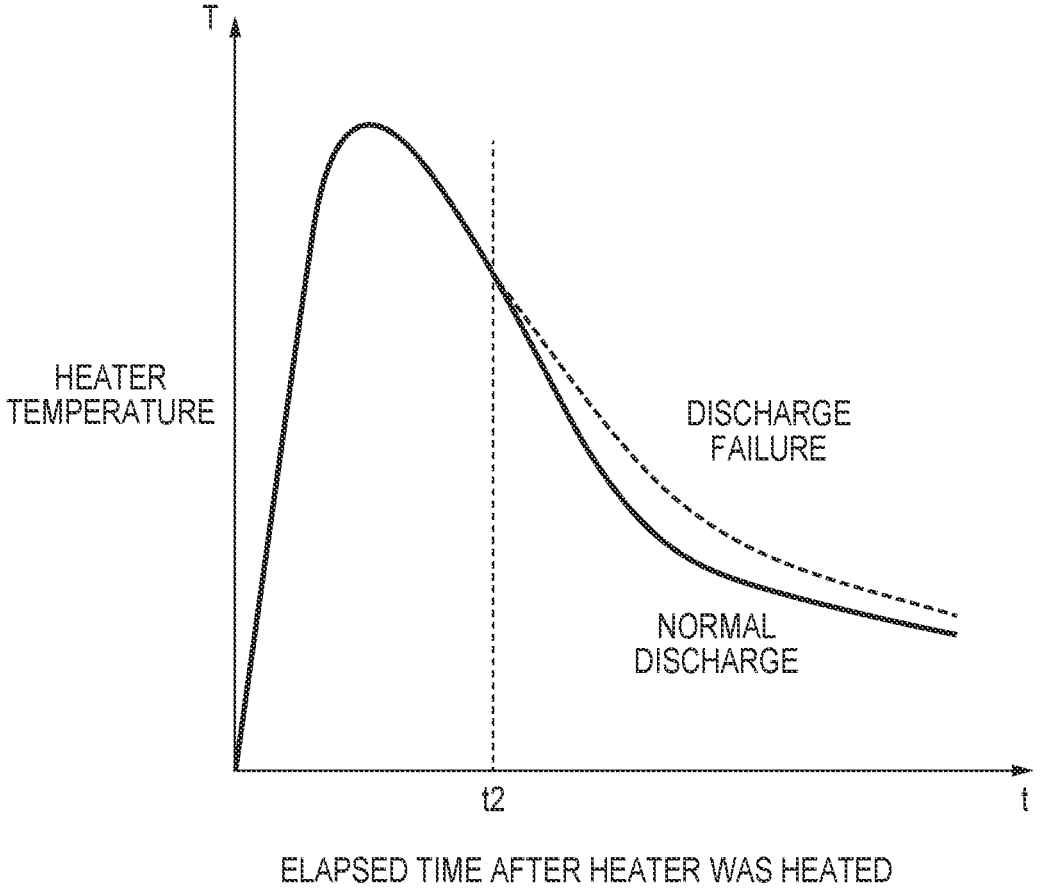
FIG. 5 is a graph showing a temperature change detected by a temperature sensor in a case in which ink discharge is normally performed and in a case in which a discharge failure has occurred.

FIG. 5 is a graph showing a temperature change detected by the temperature sensor 105 in a case in which ink discharge is normally performed and in a case in which a discharge failure has occurred. In particular, FIG. 5 shows a temperature change under the surface of the anti-cavitation film 113 in the discharge state. In addition, t=t2 in FIG. 5 corresponds to t=t2 in FIG. 4A.

According to FIG. 5, at the time of ink discharge failure, since the bubbles always exist on the surface of the anti-cavitation film 113, an abrupt temperature change does not occur, and the temperature slowly lowers. On the other hand, at the time of normal ink discharge, since the heat transfers to the ink side at the timing t=t2, the temperature on the surface of the anti-cavitation film 113 abruptly lowers. This occurs because in a case in which the temperature sensor 105 has a positive resistance temperature coefficient, when the temperature lowers, the resistance value of the temperature sensor 105 lowers, and in a case of a constant current, the output voltage decreases.

Embodiments that implement an arrangement for judging an ink discharge state in consideration of the characteristic of a temperature change of a heater in an ink discharge operation in an element substrate integrated on a printhead having an arrangement as described above will be described next.

First Embodiment

Figure 6A:
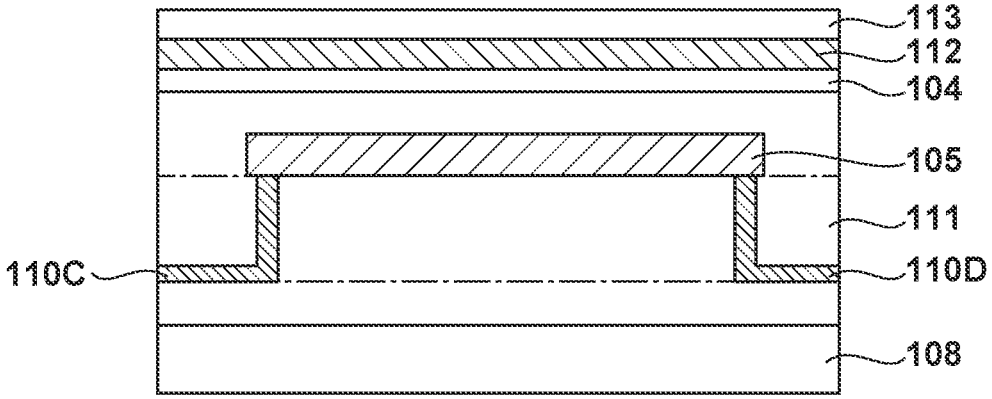
FIGS. 6A and 6B are views showing the arrangement configuration of a temperature sensor and a heater according to the first embodiment.
Figure 6B:
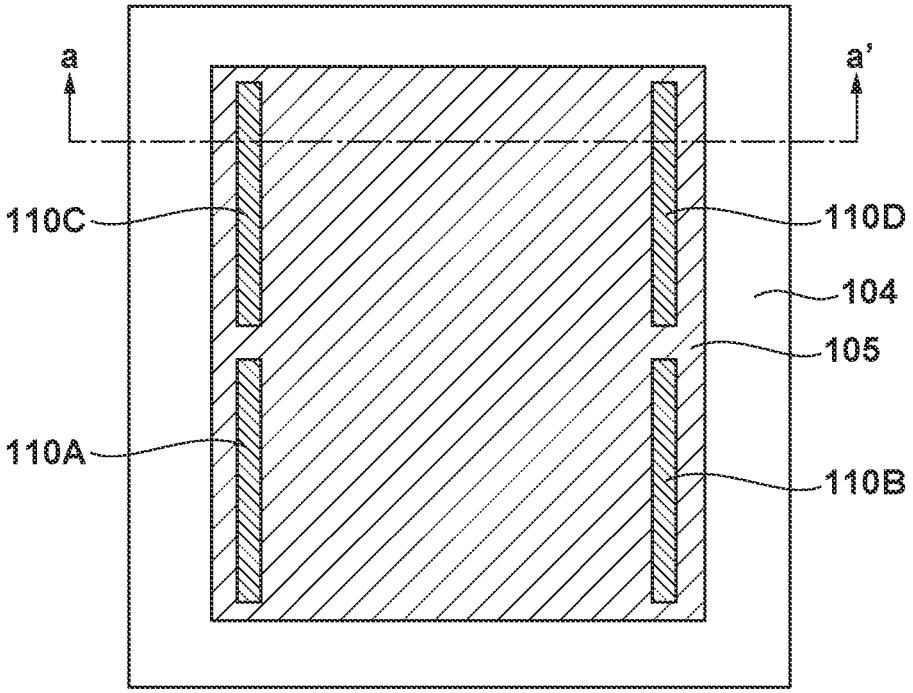

FIGS. 6A and 6B are views showing the arrangement configuration of a temperature sensor and a heater. FIG. 6A is a side sectional view taken along a line a-a', like FIG. 3B, and FIG. 6B is a plan view with focus placed on one heater and its temperature sensor.

As shown in FIG. 6B, in this embodiment, a temperature sensor 105 is arranged at the center of a heater 104, and wirings 110A, 110B, 110C, and 110D are arranged at the four corners of the temperature sensor 105. The wirings are connected to a terminal 106. This makes it possible to measure the electric resistance and the voltage between any desired wirings. This makes it possible to perform the measurement while dividing the area of the temperature sensor 105. This point will be described later.

Note that as for the positional relationship between the heater 104 and the temperature sensor 105, the heater 104 and the temperature sensor 105 need only at least partially overlap each other in a planar view of the element substrate. To accurately detect the temperature, the center portion of the heater 104 and the center portion of the temperature sensor 105 preferably overlap. In addition, the area where the heater 104 and the temperature sensor 105 overlap is preferably large.

As shown in FIG. 6A, the temperature sensor 105 is arranged under the heater 104 while sandwiching an inter-layer insulation layer 111, and the wirings 110C and 110D are connected on the lower side of the temperature sensor 105. Note that the wirings 110A and 110B are also connected on the lower side of the temperature sensor 105, although not illustrated in FIG. 6A.

Additionally, in this embodiment, the temperature sensor 105 is electrically connected by the wirings 110A to 110D. Instead of this form, the temperature sensor 105 may electrically be connected by a plug formed by tungsten or the like in another layer. That is, the temperature sensor 105 and the wirings 110A to 110D may be connected via a plug. In this case, the plug is preferably connected to the peripheral edge portion of the temperature sensor 105. The plug can have a slit shape or a hole shape.

FIGS. 7A to 8B are views schematically showing the flow of an electric current between wirings by selectively using four wirings provided on the temperature sensor.

When the wirings are provided at four portions (two portions on each of two sides facing each other) of the peripheral edge portion of the temperature sensor 105 that has a rectangular thin film shape, as described above, the resistance and the output voltage of the temperature sensor between some wirings like the following can be monitored, as shown in FIGS. 7A to 8B.

Figure 7A:
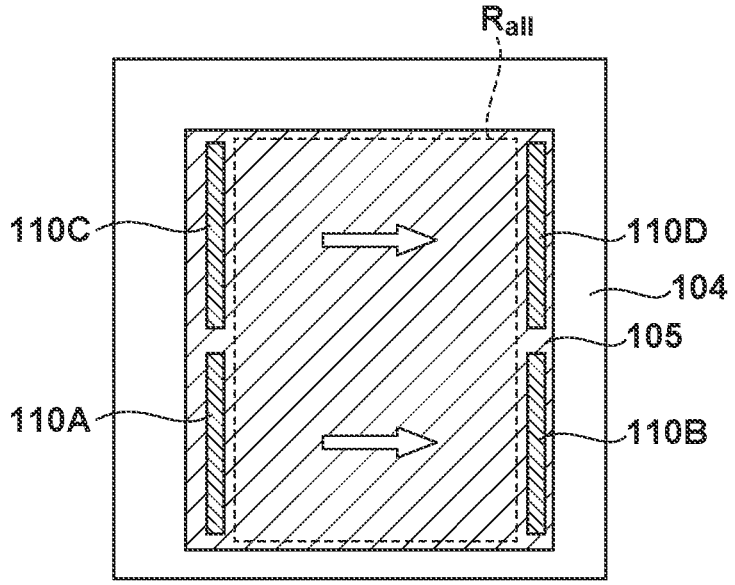
FIGS. 7A, 7B, and 7C are views schematically showing the flow of a current between wirings by selectively using four wirings provided on the temperature sensor.

That is, as shown in FIG. 7A, when the wiring 110A and the wiring 110C are regarded as one wiring AC, and the wiring 110B and the wiring 110D are regarded as one wiring BD, a resistance $R_{all}$ and the output voltage of the temperature sensor 105 between the wiring AC and the wiring BD can be monitored.

Figure 7B:
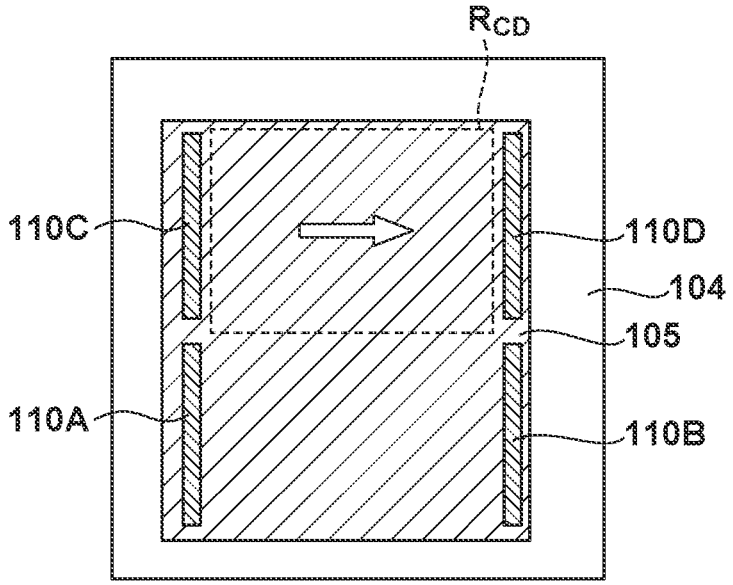
Figure 7C:
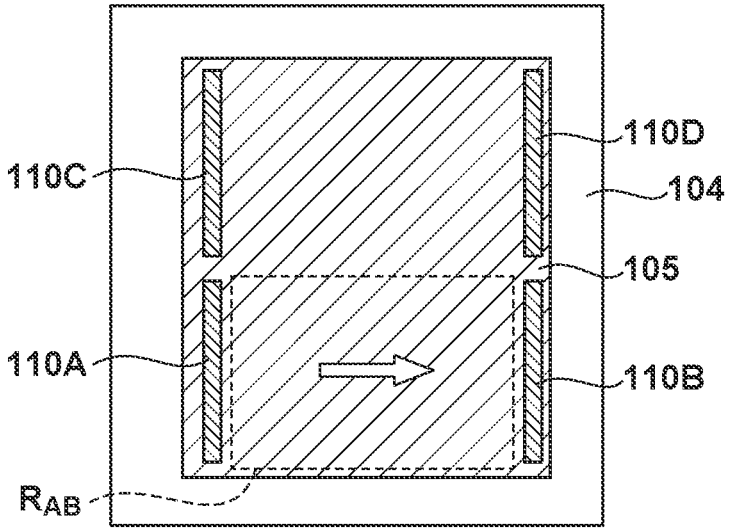
Figure 8B:
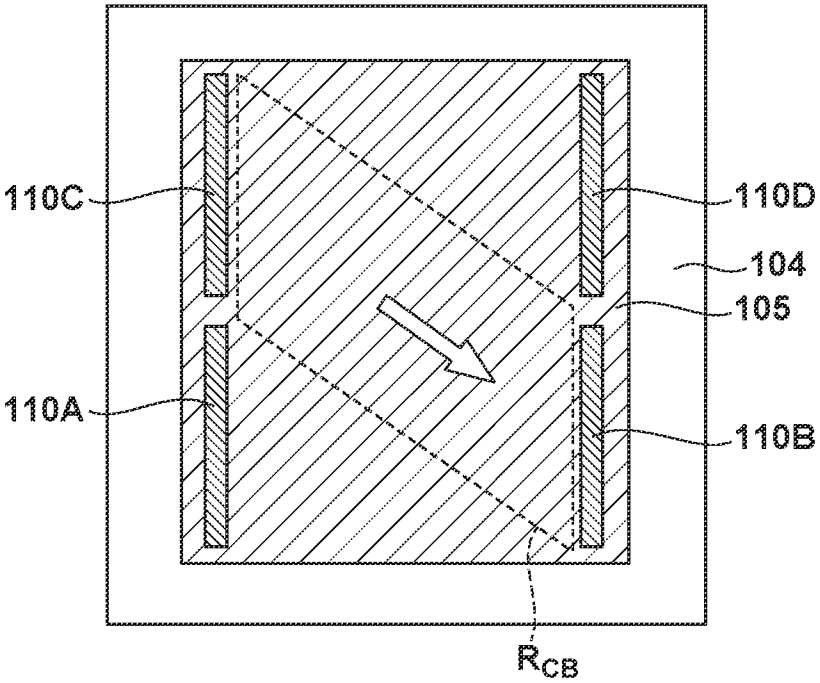
FIGS. 8A and 8B are views schematically showing the flow of a current between wirings by selectively using four wirings provided on the temperature sensor.
Figure 8A:
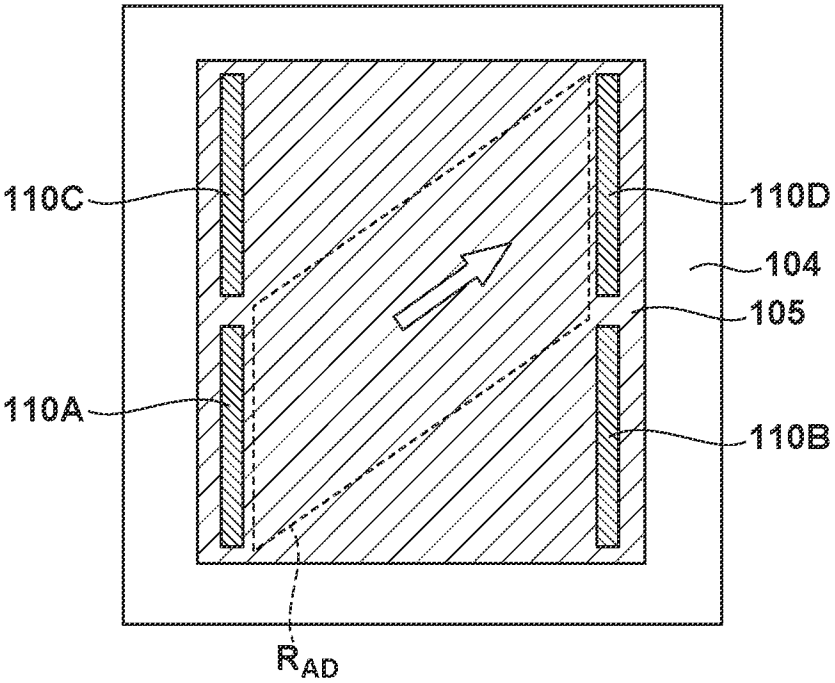

In addition, as shown in FIG. 7B, a resistance RCD and the output voltage of the temperature sensor 105 between the wiring 110C and the wiring 110D can be monitored. As shown in FIG. 7C, a resistance RAB and the output voltage of the temperature sensor 105 between the wiring 110A and the wiring 110B can be monitored. Furthermore, as shown in FIG. 8A, a resistance RAD and the output voltage of the temperature sensor 105 between the wiring 110A and the wiring 110D can be monitored. As shown in FIG. 8B, a resistance $R_{CB}$ and the output voltage of the temperature sensor 105 between the wiring 110C and the wiring 110B can be monitored.

As described above, in this embodiment, the resistance and the output voltage of the temperature sensor between any desired wirings can be monitored. If a maximum region where the temperature can be detected by the temperature sensor is set to a predetermined region, the temperature can be detected in a plurality of sub-regions of the predetermined region.

Figure 9:
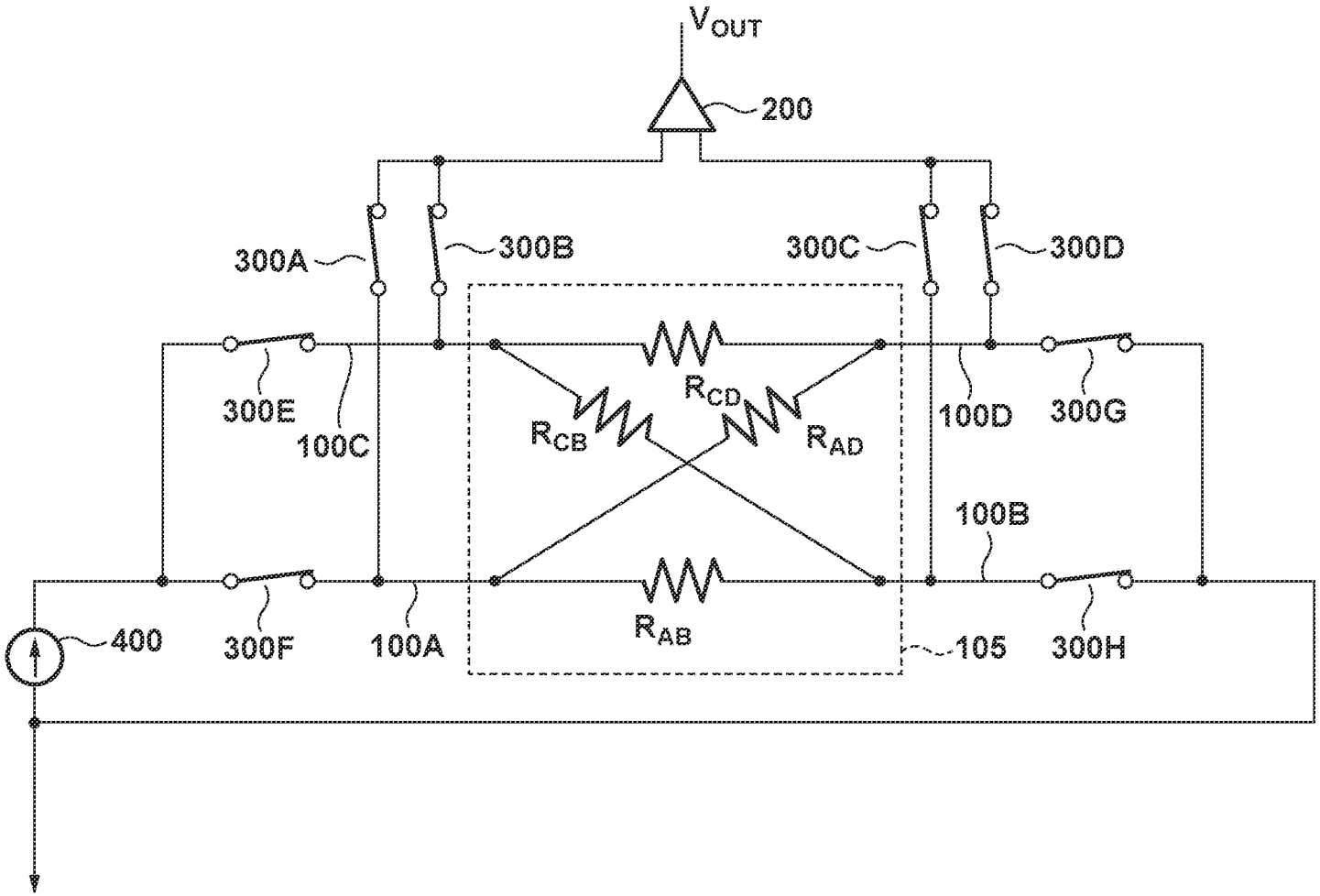
FIG. 9 is an equivalent circuit diagram showing the arrangement of a temperature detection circuit using the temperature sensor with the arrangement shown in FIGS. 7A to 8B.

FIG. 9 is an equivalent circuit diagram showing the arrangement of a temperature detection circuit using the temperature sensor with the arrangement shown in FIGS. 7A to 8B.

As shown in FIG. 9, the temperature detection circuit includes a current supply source 400 configured to supply a constant current to the temperature sensor 105, and a differentiator (comparator) 200 configured to measure a potential difference generated in the temperature sensor 105. With this arrangement, when a current flows to the temperature sensor 105, a change in the resistance value caused by a temperature change can be output as a voltage. Additionally, in this arrangement, the resistances $R_{AB}$, $R_{CD}$, $R_{AD}$, and $R_{CB}$ and the output voltage of the temperature sensor 105 can be measured by turning on/off switching elements 300A to 300D. Of this temperature detection circuit, all components except the current supply source 400 are integrated on the element substrate.

More specifically, to measure the resistance $R_{AB}$, when switches 300F and 300H are turned on, the two terminals of the resistance $R_{AB}$ are rendered conductive. When the switches 300A and 300C are turned on, the potential difference between the terminals of the resistance $R_{AB}$ is obtained as an output voltage $V_{out}$ from the differentiator 200. To measure the resistance $R_{CD}$, when switches 300E and 300G are turned on, the two terminals of the resistance $R_{CD}$ are rendered conductive. When the switches 300B and 300D are turned on, the potential difference between the terminals of the resistance $R_{CD}$ is obtained as the output voltage $V_{out}$ from the differentiator 200.

To measure the resistance $R_{CB}$, when switches 300E and 300H are turned on, the two terminals of the resistance $R_{CB}$ are rendered conductive. When the switches 300B and 300C are turned on, the potential difference between the terminals of the resistance $R_{CB}$ is obtained as the output voltage $V_{out}$ from the differentiator 200. To measure the resistance $R_{AD}$, when switches 300F and 300G are turned on, the two terminals of the resistance $R_{AD}$ are rendered conductive. When the switches 300A and 300D are turned on, the potential difference between the terminals of the resistance $R_{AD}$ is obtained as the output voltage $V_{out}$ from the differentiator 200.

In addition, when all the eight switches (switching elements) are turned on, the resistance $R_{all}$ can also be measured.

Note that these switches are turned on/off by a control signal supplied from the outside (the main body part of the printing apparatus).

An ink discharge state judgment method using the temperature sensor and the temperature detection circuit of the above-described arrangement will be described next.

The discharge state is judged using a change in the heater temperature detected by the temperature sensor, which occurs when a part of an ink droplet generated upon discharge comes into contact with the surface of the anti-cavitation film 113, as described above. Normally, the part of the ink droplet drops to the center portion of the heater 104. However, if a foreign substance exists near a nozzle 103, or the water repellency of the surface of the nozzle 103 varies, the drop of the part of the ink droplet generated upon discharge may deviate from the center portion of the heater 104. This phenomenon is called a deviation. It is also found that at that time, the main droplet (120 in FIG. 4B) of the discharged ink droplet also lands to a point deviated from a desired position on a print medium. For this reason, judging whether a deviation has occurred in the part of the ink droplet, which is in contact with the anti-cavitation film 113, leads to more correct grasp of the discharge state.

A method of judging the deviation direction will be described here.

Figure 10A:
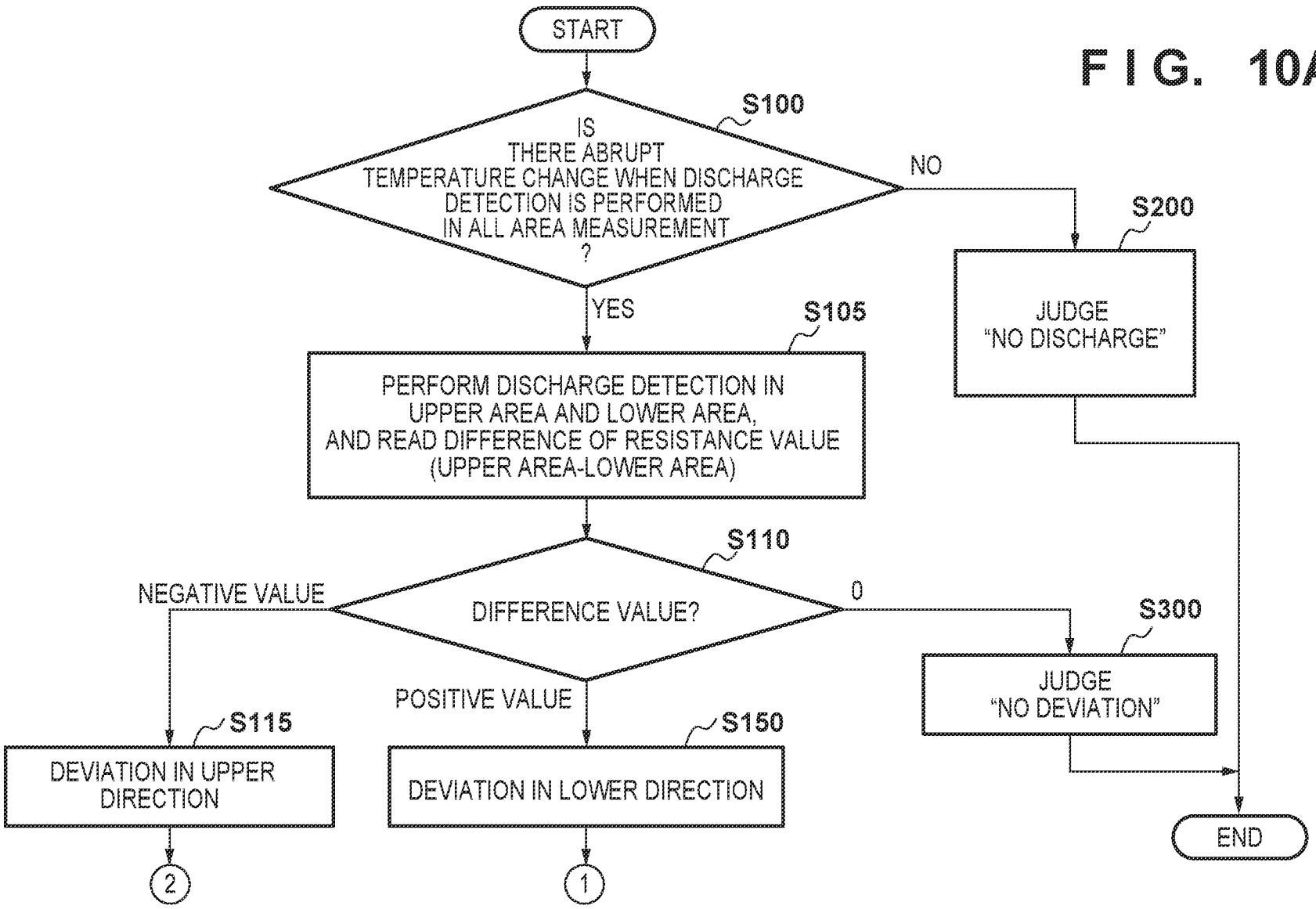
FIGS. 10A and 10B are flowcharts showing a discharge state judgment method.
Figure 10B:
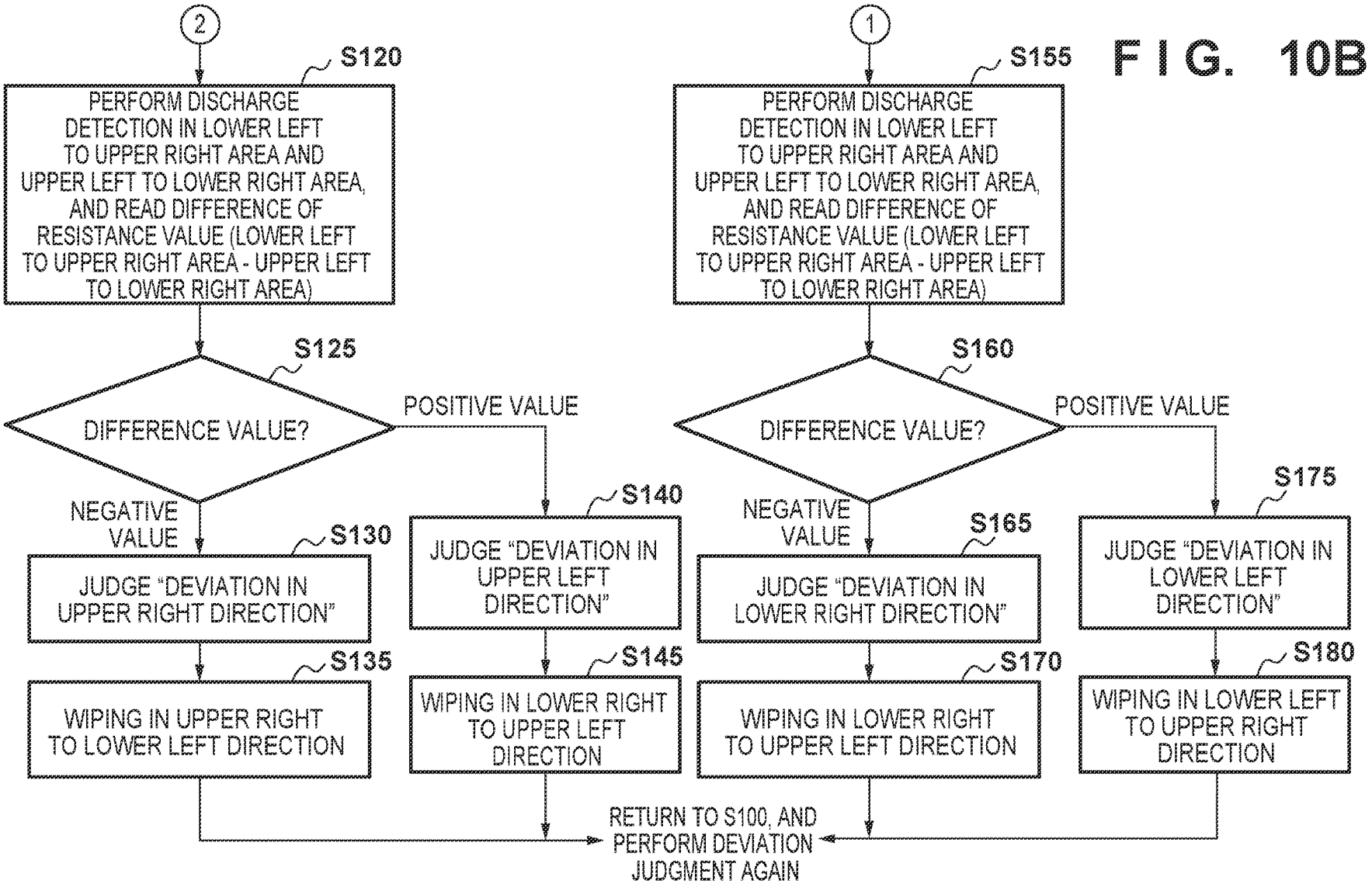

FIGS. 10A and 10B are flowcharts showing a discharge state judgment method.

First, in step S100, using the wirings AC and BD, as shown in FIG. 7A, the time-rate change of the heater temperature is monitored using the resistance $R_{all}$ of all areas of the temperature sensor 105, which occurs according to the ink discharge operation, thereby checking whether an abrupt temperature change exists. If an abrupt temperature change does not exist, the process advances to step S200 to judge that an ink discharge failure has occurred (discharge failure judgment). On the other hand, if an abrupt temperature change exists, and it is judged that the ink is normally discharged, the process advances to step S105 to perform deviation judgment processing.

Deviation judgment will be described here. In the heater of a nozzle that has normally discharged ink, since abrupt temperature lowering occurs, the resistance value of the temperature sensor lowers. Deviation judgment to be described below is performed using this phenomenon.

That is, in step S105, as shown in FIG. 7B, the resistance RCD at the time of ink discharge in the upper area of the temperature sensor 105 surrounded by a broken line is measured using the wiring 110C and the wiring 110D. Similarly, as shown in FIG. 7C, the resistance RAB at the time of ink discharge in the lower area of the temperature sensor 105 surrounded by a broken line is measured using the wiring 110A and the wiring 110B. At this time, the measurement is preferably performed at the timing from t=t2 in FIG. 5 because the difference between the resistances $R_{CD}$ and $R_{AB}$ of the temperature sensor 105 becomes large. The difference between the resistances ($R_{CD}$-$R_{AB}$: difference (upper area to lower area)) is read.

In step S110, the value of the difference is checked. If the difference ($R_{CD}$-$R_{AB}$) is zero, that is, if there is no difference, or the difference is equal to or smaller than a judgment threshold, the process advances to step S300 to judge that "there is no deviation" in the upper to lower direction. On the other hand, if the difference ($R_{CD}$-$R_{AB}$) is negative (−) or exists on the negative side of the judgment threshold, the process advances to step S115 to judge that "there is a deviation in the upper direction". If the difference ($R_{CD}$-$R_{AB}$) is positive (+) or exists on the positive side of the judgment threshold, the process advances to step S150 to judge that "there is a deviation in the lower direction".

If it is judged that "there is a deviation in the upper direction", in step S120, as shown in FIG. 8A, the resistance $R_{AD}$ at the time of ink discharge in the lower left to upper right area of the temperature sensor is measured using the wiring 110A and the wiring 110D. If it is judged that "there is a deviation in the lower direction", in step S155, as shown in FIG. 8A, the resistance RAD at the time of ink discharge in the lower left to upper right area of the temperature sensor is measured using the wiring 110A and the wiring 110D. Similarly, in steps S120 and S155, as shown in FIG. 8B, the resistance $R_{CB}$ at the time of ink discharge in the upper left to lower right area of the temperature sensor is measured using the wiring 110B and the wiring 110C. The difference between the resistances ($R_{AD}$-$R_{CB}$: difference (lower left to upper right area)−(upper left to lower right area)) is read.

In steps S125 and S160, the value of the difference is checked.

In a case in which it is judged in step S115 that "there is a deviation in the upper direction", if the difference is negative (−) or exists on the negative side of the judgment threshold as the result of read of the difference of the resistances in step S120 and the check of the value of the difference, the process advances to step S130. It is judged that "there is a deviation in the upper right direction". On the other hand, if the difference is positive (+) or exists on the positive side of the judgment threshold, the process advances to step S140 to judge that "there is a deviation in the upper left direction".

In a case in which it is judged in step S150 that "there is a deviation in the lower direction", if the difference is negative (−) or exists on the negative side of the judgment threshold as the result of read of the difference of the resistances in step S155 and the check of the value of the difference, the process advances to step S165. It is judged that "there is a deviation in the lower right direction". On the other hand, if the difference is positive (+) or exists on the positive side of the judgment threshold, the process advances to step S175 to judge that "there is a deviation in the lower left direction".

After the deviation direction is judged in one of steps S130, S140, S165, and S175 in the above-described way, in step S135, S145, S170, or S180, the moving direction of a wiping blade configured to cleanse the periphery of the nozzle is decided. This is deciding the moving direction of the wiping blade provided in a recovery mechanism provided on the lower right side of the printing apparatus 1 shown in FIG. 1 and configured to wipe the ink discharge surface of a printhead 3. The wiping blade is moved in accordance with the decision to perform wiping.

The wiping blade is normally provided along the array direction of the plurality of nozzles of the printhead or such that the blade direction is set in a direction orthogonal to the array direction. The wiping blade is moved in the direction orthogonal to the blade direction, thereby wiping the nozzles or a peripheral region thereof. In this embodiment, a mechanism capable of changing the moving direction of the wiping blade with respect to the nozzles by rotating the wiping blade about a rotation axis orthogonal to the blade direction is provided. Hence, when the element substrate is viewed from the upper side in the nozzle direction, as shown in FIGS. 7A to 8B, the wiping blade can be moved with respect to the nozzles from right to left, from left to right, from upper right to lower left, from upper left to lower right, from lower left to upper right, and from lower right to upper left.

It is considered that, for example, when the element substrate is viewed from the upper side in the nozzle direction, as shown in FIGS. 7A to 8B, if a foreign substance exists on the upper right side of a nozzle, a deviation occurs on the lower left side in the diagonal direction of the foreign substance due to the influence of the foreign substance. Hence, when wiping is performed from the lower left to upper right direction, the foreign substance can be removed without being taken into the nozzle.

After wiping is performed in the direction decided in one of steps S135, S145, S170, and S180, deviation judgment is performed again. That is, the process returns to step S100 to repeat the above-described processing. If a deviation still occurs after the processing, the nozzle is judged as a discharge failure (discharge failure judgment).

Hence, according to the above-described embodiment, one temperature sensor is made to correspond to one electrothermal transducer, four wirings can be connected to the peripheral edge portion of temperature sensor, and two different wirings in the four wirings are selected and rendered conductive, thereby measuring the resistance value or potential difference (voltage). Hence, even if two temperature sensors are not made to correspond to one electrothermal transducer, two or more (here, four) resistance values or potential differences (voltages) can be obtain using one temperature sensor, and the reliability of discharge state judgment can be increased. In addition, since four wirings are provided for the temperature sensor corresponding to each heater, and wirings to be used to measure the heater temperature by supplying a constant current can be selected, not only discharge failure judgment for each nozzle but also deviation direction judgment based on the measurement result can be performed. Since this makes it possible to remove a foreign substance by an appropriate wiping operation, the ink discharge state from the nozzles can be maintained satisfactorily.

Additionally, as can be seen from the structure shown in FIGS. 6A and 6B, in the element substrate, the center portion of the heater 104 and the center portion of the temperature sensor 105 overlap. The temperature sensor is patterned into a rectangular shape on a planar view, and its inside is not patterned. It is therefore possible to detect the temperature of the center portion of the temperature sensor, where the temperature become high, and it is possible to ensure a region where temperature detection is possible while suppressing occurrence of a region where temperature detection is impossible.

Note that if two temperature sensors are arranged as in Japanese Patent Laid-Open No. 2015-214079, it is assumed that a portion sandwiched by steps generated by the space between the two temperature sensors is formed. In this case, at the time of film forming of the interlayer insulation layer between the temperature sensor and the electrothermal transducer, a cavity may be created in the portion sandwiched between the steps because the coverage is not sufficient. In particular, because of the nature of detecting the temperature of the electrothermal transducer as a voltage, to raise the output voltage, that is, to raise the sensitivity, an arrangement in which the two temperature sensors are arranged in places close to the center of the electrothermal transducer is required. In this case, since the two temperature sensors are arranged close, the possibility that a cavity is created becomes high.

If such a cavity is created, coverage of the electrothermal transducer, the protection film, the anti-cavitation film, and the like, which are located between the two temperature sensors, is insufficient, and it may be difficult to ensure a desired membrane or a desired film thickness.

In addition, a cavitation readily strongly occurs particularly at the center portion of the electrothermal transducer. Hence, if a membrane or film thickness is not ensured for the center portion of the electrothermal transducer or the film that covers the portion, the reliability of the element substrate of the printhead may lower.

In the arrangement of this embodiment, however, the coverage of the center portion of the heater and the interlayer insulation layer 111 located immediately under that and sandwiched between the temperature sensor and the heater is satisfactory. Similarly, the coverage of the heater 104, a protection film 112, and the anti-cavitation film 113 is satisfactory. Hence, at the time of film forming of the interlayer insulation layer between the temperature sensor and the electrothermal transducer as described above, there is no possibility that a cavity is created due to a coverage failure, and a reliable element substrate is formed.

Second Embodiment

Figure 13A:
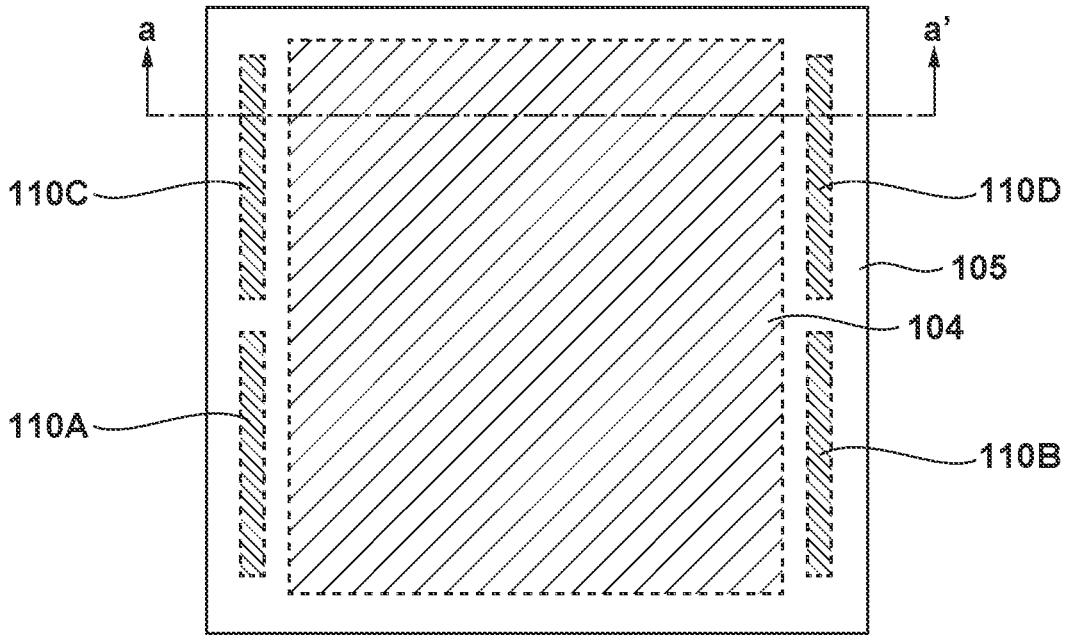
FIGS. 13A and 13B are views showing the arrangement configuration of a temperature sensor and a heater according to the second embodiment.
Figure 13B:
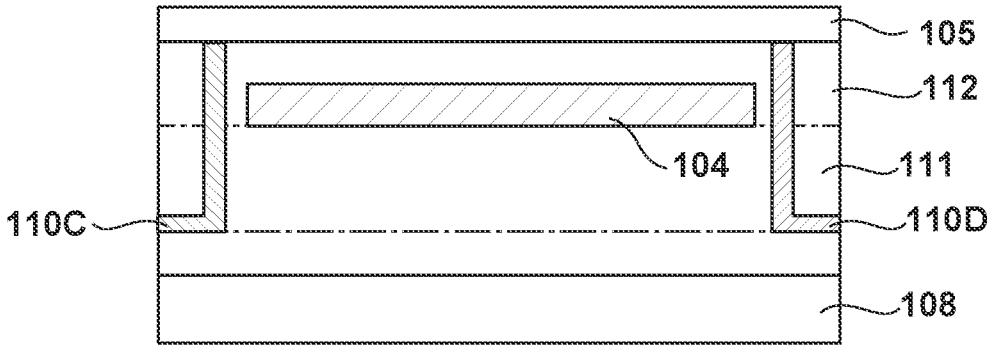

FIGS. 13A and 13B are views showing the arrangement configuration of a temperature sensor and a heater according to the second embodiment. In this embodiment, the temperature sensor located immediately under the heater is removed from the arrangement shown in the first embodiment, as shown in FIGS. 13A and 13B, and instead, an anti-cavitation film also serves as a temperature sensor 105. In addition, wirings 110C and 110D are connected on the lower side of the temperature sensor 105 also serving as an anti-cavitation film.

Note that wirings 110A and 110B are also connected on the lower side of the temperature sensor 105, although not illustrated in FIG. 13B. The rest is the same as in the first embodiment. With this arrangement, since the temperature sensor 105 need not be provided separately from the anti-cavitation film, the manufacturing processes can be decreased. Additionally, in the temperature sensor 105 also serving as the anti-cavitation film, measurement can be performed while dividing the area of the temperature sensor 105 in a state in which the heater is wholly covered, as in the first embodiment.

Note that although the above-described embodiments illustrate an example in which the four wirings are provided to the respective temperature sensors as shown in FIGS. 6-8, the present invention is not limited to this. For example, the wiring arrangements as shown in FIGS. 11 and 12 can also be applicable.

Figure 11:
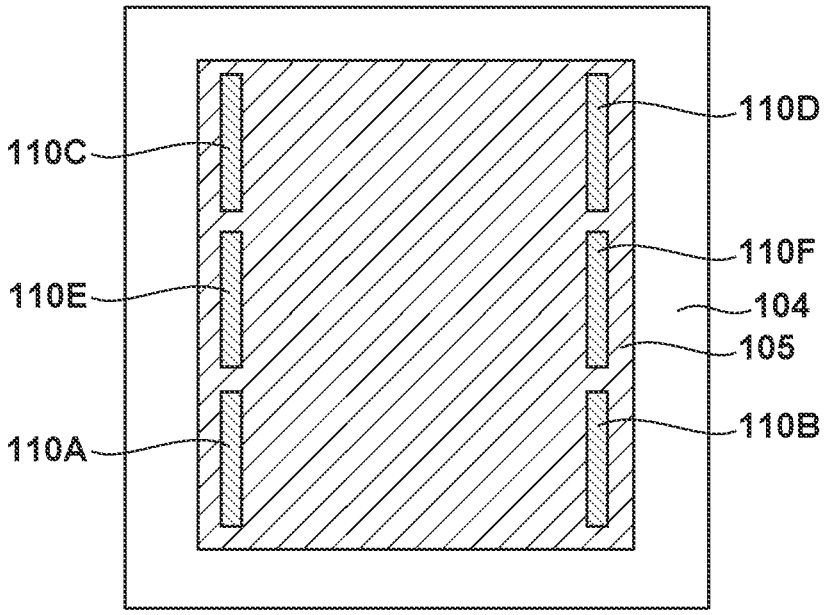
FIG. 11 is a view showing the arrangement configuration of a temperature sensor, a heater, and the wirings of the temperature sensor.

FIG. 11 shows an example in which two wirings 110E and 110F are added to a temperature sensor, as compared to an example in FIG. 6. As shown in FIG. 11, it is possible to divide the temperature detection area into smaller areas by increasing the number of wirings to six (6).

Figure 12:
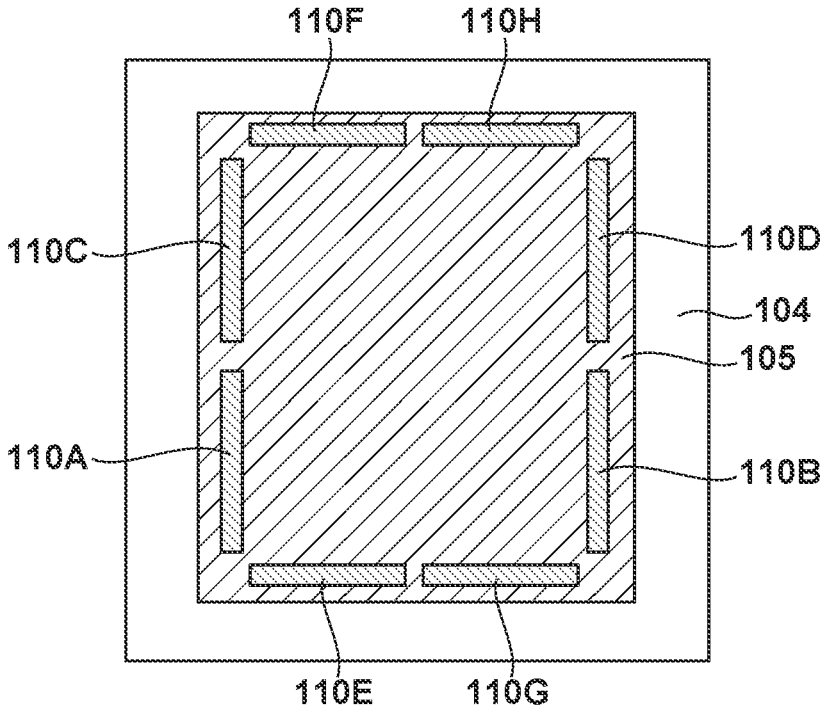
FIG. 12 is a view showing the arrangement configuration of a temperature sensor, a heater, and the wirings of the temperature sensor.

FIG. 12 shows another example in which wirings 110E, 110F, 110G and 110H are added to a temperature sensor, as compared to an example in FIG. 6. As shown in FIG. 12, it is possible to divide the temperature detection area into smaller areas by increasing the number of wirings to eight (8). Particularly, in this case, it is possible to send an electric current in a vertical direction.

Also, the temperature sensor may perform temperature detection on at least two areas of a predetermined region. For example, consider a case where there are a wiring as a single wiring formed by a wiring 110A and a wiring 110C, a wiring 110B and a wiring 110D in FIG. 6. In this case, it is possible to perform temperature detection on two areas which partially overlap with each other by sending an electric current between the wiring and the wiring 110B, and sending an electric current between the wiring and the wiring 110D. Thus, with this simple arrangement, it is possible to perform temperature detection on a plurality of areas.

The flowchart shown in FIG. 10 illustrates a case where whether a deviation occurs in any of four areas is judged, and a wiping operation is controlled in accordance with a result of the judgment. However, the present invention is not limited to this. For example, it is also possible to perform judgment on two areas (e.g. deviation in upper direction, and deviation in lower direction) at step S115 and step S150, and control a relative moving direction between a wiping blade and an ink discharge surface in accordance with a result of the judgment. This makes it possible to easily perform temperature detection and recovery operation. Note that a recovery unit controlled based on the result of judgment is not limited to the wiping blade. Another recovery unit may be controlled in accordance with the result of judgment.

Note that in the above-described embodiments, the printhead that discharges ink and the printing apparatus have been described as an example. However, the present invention is not limited to this. The present invention can be applied to an apparatus such as a printer, a copying machine, a facsimile including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiments can also be considered as a liquid discharge head in general. The substance discharged from the head is not limited to ink, and can be considered as a liquid in general.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-127883, filed Jul. 9, 2019, and 2020-100273, filed Jun. 9, 2020, which are hereby incorporated by reference herein in their entirety.

What is claimed is:

1. An element substrate comprising:

an electrothermal transducer;

a temperature detection element formed at a position where the temperature detection element at least partially overlaps the electrothermal transducer in a planar view of the element substrate;

a plurality of wirings connected to the temperature detection element;

a plurality of switches corresponding to the plurality of wirings, respectively, and configured to turn on/off connection of the wirings in accordance with a control signal from an outside; and a comparator configured to compare a potential difference between different positions of the temperature detection element connected by wirings turned on by the plurality of switches, wherein the temperature detection element can detect temperatures in a plurality of regions when a plurality of different wirings out of the plurality of wirings are selected, wherein the temperature detection element comprises a rectangular thin film resistor, and wherein the plurality of wirings are formed in a layer different from a layer where the thin film resistor is formed, and connected to a peripheral edge portion of the thin film resistor.

2. The element substrate according to claim 1, wherein the element substrate includes a base, and has the electrothermal transducer and the temperature detection element in a multilayer structure provided on the base, and the temperature detection element is provided between the base and the electrothermal transducer.

3. The element substrate according to claim 1, wherein the element substrate includes a base, and has the electrothermal transducer and the temperature detection element in a multilayer structure provided on the base, and the electrothermal transducer is provided between the base and the temperature detection element.

4. The element substrate according to claim 3, wherein the temperature detection element also serves as an anti-cavitation film configured to cover the electrothermal transducer.

5. The element substrate according to claim 1, wherein the plurality of wirings comprise four wirings, and the four wirings are connected to two portions of each of two sides facing each other on the peripheral edge portion of the thin film resistor.

6. The element substrate according to claim 1, wherein the plurality of wirings comprise six wirings, and the six wirings are connected to three portions of each of two sides facing each other on the peripheral edge portion of the thin film resistor.

7. The element substrate according to claim 1, wherein the plurality of wirings comprise eight wirings, and the eight wirings are connected to two portions of each of four sides of a rectangle on the peripheral edge portion of the thin film resistor.

8. The element substrate according to claim 1, wherein each of the electrothermal transducer and the temperature detection element comprises a plurality of elements.

* * * * *